US008888225B2

(12) United States Patent
Donaldson et al.

(10) Patent No.: US 8,888,225 B2
(45) Date of Patent: Nov. 18, 2014

(54) METHOD FOR CALIBRATING OPTICAL DETECTOR OPERATION WITH MARKS FORMED ON A MOVING IMAGE RECEIVING SURFACE IN A PRINTER

(71) Applicant: Xerox Corporation, Norwalk, CT (US)

(72) Inventors: Patricia Joanne Donaldson, Pittsford, NY (US); James Patrick Kitchen, Webster, NY (US); Jeffrey Michael Gramowski, North Chili, NY (US)

(73) Assignee: Xerox Corporation, Norwalk, CT (US)

( * ) Notice: Subject to any disclaimer, the term of this patent is extended or adjusted under 35 U.S.C. 154(b) by 62 days.

(21) Appl. No.: 13/866,275

(22) Filed: Apr. 19, 2013

(65) Prior Publication Data

US 2014/0313256 A1 Oct. 23, 2014

(51) Int. Cl.
*B41J 29/393* (2006.01)

(52) U.S. Cl.
CPC ..... *B41J 29/393* (2013.01)
USPC ..... 347/19

(58) Field of Classification Search
USPC ..... 347/19, 16, 14
See application file for complete search history.

(56) References Cited

U.S. PATENT DOCUMENTS 4,401,024 A 8/1983 Frentress
4,887,530 A 12/1989 Sainio
5,325,159 A 6/1994 Day
5,343,231 A 8/1994 Suzuki
5,451,990 A 9/1995 Sorenson et al.
5,539,498 A 7/1996 De Cock et al.
5,600,350 A 2/1997 Cobbs et al.
5,796,414 A * 8/1998 Sievert et al. ..... 347/19
5,887,236 A 3/1999 Hirao et al.
6,049,680 A 4/2000 Goris et al.
6,072,587 A 6/2000 Hicks
6,076,915 A 6/2000 Gast et al.
6,089,693 A 7/2000 Drake et al.
6,109,722 A 8/2000 Underwood et al.
6,196,652 B1 3/2001 Subirada et al.
6,266,437 B1 7/2001 Eichel et al.
6,275,600 B1 8/2001 Banker et al.
6,300,968 B1 10/2001 Kerxhalli et al.
6,310,637 B1 10/2001 Shimada et al.
6,334,720 B1 1/2002 Kato et al.
6,352,331 B1 3/2002 Armijo et al.
6,377,758 B1 4/2002 OuYang et al.
6,467,867 B1 10/2002 Worthington et al.
6,478,401 B1 * 11/2002 King et al. ..... 347/19
6,494,558 B1 12/2002 Doval et al.
6,554,390 B2 4/2003 Arquilevich et al.
6,637,853 B1 10/2003 Ahne et al.
6,639,669 B2 10/2003 Hubble, III et al.
6,655,771 B2 12/2003 Matsumoto et al.

(Continued)

*Primary Examiner* — Kristal Feggins
(74) *Attorney, Agent, or Firm* — Maginot Moore & Beck LLP

(57) ABSTRACT

A method for calibration of an optical sensor to scan printed marks in a printer includes operating inkjets to form printed marks on an image receiving surface and activating the optical sensor after the image receiving surface moves a predetermined distance to generate scanned image data of a region of the image receiving surface that is longer than the region containing the printed marks. The method includes identifying an error between the location of the printed marks in the scanned image data and a predetermined expected location for the marks, and adjustment of the distance that the image receiving surface moves prior to activation of the optical sensor to correct the error.

19 Claims, 4 Drawing Sheets

(56) References Cited

U.S. PATENT DOCUMENTS

| | | | |
|---|---|---|---|
| 6,847,465 | B1 | 1/2005 | Wetchler et al. |
| 6,883,892 | B2 | 4/2005 | Sievert et al. |
| 6,942,313 | B2 | 9/2005 | Kanda |
| 6,993,275 | B2 | 1/2006 | Mitsuya et al. |
| 7,073,883 | B2 | 7/2006 | Billow |
| 7,118,188 | B2 | 10/2006 | Vilanova et al. |
| 7,193,640 | B2 | 3/2007 | Egan |
| 7,254,254 | B2 | 8/2007 | Ueda et al. |
| 7,309,118 | B2 | 12/2007 | Mizes et al. |
| 7,380,897 | B2 | 6/2008 | Anderson et al. |
| 7,390,073 | B2 | 6/2008 | Bailey et al. |
| 7,391,525 | B2 | 6/2008 | Chapman et al. |
| 7,478,894 | B2 | 1/2009 | Kim et al. |
| 7,515,305 | B2 | 4/2009 | Mizes |
| 7,549,721 | B2 | 6/2009 | Nakano et al. |
| 7,552,986 | B2 | 6/2009 | Mizes et al. |
| 7,584,699 | B2 | 9/2009 | Ford |
| 7,607,752 | B2 | 10/2009 | Childers et al. |
| 7,630,519 | B2 | 12/2009 | Nagarajan |
| 7,630,653 | B2 | 12/2009 | Bonino |
| 7,637,586 | B2 | 12/2009 | Yun |
| 7,647,018 | B2 | 1/2010 | Moore et al. |
| 7,686,298 | B2 | 3/2010 | Fioravanti et al. |
| 2002/0131800 | A1 | 9/2002 | Jacob et al. |
| 2002/0135629 | A1* | 9/2002 | Sarmast et al. ..... 347/19 |
| 2003/0231350 | A1 | 12/2003 | Yamagishi |
| 2004/0160468 | A1 | 8/2004 | Kim et al. |
| 2005/0099447 | A1 | 5/2005 | Hsu et al. |
| 2006/0072939 | A1 | 4/2006 | Kremer et al. |
| 2006/0109329 | A1 | 5/2006 | Holtman et al. |
| 2006/0109330 | A1 | 5/2006 | Holtman |
| 2006/0114302 | A1 | 6/2006 | Holtman |
| 2008/0062219 | A1 | 3/2008 | Mizes et al. |
| 2008/0124158 | A1 | 5/2008 | Folkins |
| 2009/0079780 | A1 | 3/2009 | Picciotto et al. |
| 2009/0265950 | A1 | 10/2009 | Mizes et al. |
| 2009/0293750 | A1 | 12/2009 | Haenni et al. |
| 2009/0322849 | A1 | 12/2009 | Calamita et al. |
| 2010/0013882 | A1 | 1/2010 | Mizes et al. |
| 2011/0273502 | A1 | 11/2011 | Eun et al. |

* cited by examiner

METHOD FOR CALIBRATING OPTICAL DETECTOR OPERATION WITH MARKS FORMED ON A MOVING IMAGE RECEIVING SURFACE IN A PRINTER

TECHNICAL FIELD

This disclosure relates generally to printers and, more specifically, to inkjet printers that use scanned image data for printhead registration and detection of missing inkjets.

BACKGROUND

Inkjet printers operate a plurality of inkjets in each printhead to eject liquid ink onto an image receiving surface. The ink can be stored in reservoirs that are located within cartridges installed in the printer. Such ink can be aqueous ink or an ink emulsion. Other inkjet printers receive ink in a solid form and then melt the solid ink to generate liquid ink for ejection onto the imaging member. In these solid ink printers, the solid ink can be in the form of pellets, ink sticks, granules, pastilles, or other shapes. The solid ink pellets or ink sticks are typically placed in an ink loader and delivered through a feed chute or channel to a melting device, which melts the solid ink. The melted ink is then collected in a reservoir and supplied to one or more printheads through a conduit or the like. Other inkjet printers use gel ink. Gel ink is provided in gelatinous form, which is heated to a predetermined temperature to alter the viscosity of the ink so the ink is suitable for ejection by a printhead. Once the melted solid ink or the gel ink is ejected onto the image receiving surface, the ink returns to a solid, but malleable form, in the case of melted solid ink, and to gelatinous state, in the case of gel ink.

A typical inkjet printer uses one or more printheads with each printhead containing an array of individual nozzles through which drops of ink are ejected by inkjets across an open gap to an image receiving surface to form an ink image. The image receiving surface can be a continuous web of recording media, a series of media sheets, or the image receiving surface can be a rotating surface, such as a print drum or endless belt. Images printed on a rotating surface are later transferred to recording media by mechanical force in a transfix nip formed by the rotating surface and a transfix roller. In an inkjet printhead, individual piezoelectric, thermal, or acoustic actuators generate mechanical forces that expel ink through an aperture, usually called a nozzle, in a faceplate of the printhead. The actuators expel an ink drop in response to an electrical signal, sometimes called a firing signal. The magnitude, or voltage level, of the firing signals affects the amount of ink ejected in an ink drop. The firing signal is generated by a printhead controller with reference to image data. A print engine in an inkjet printer processes the image data to identify which inkjets in the printheads of the printer are operated to eject a pattern of ink drops at particular locations on the image receiving surface to form an ink image corresponding to the image data. The locations where the ink drops landed are sometimes called "ink drop locations," "ink drop positions," or "pixels." Thus, a printing operation can be viewed as the placement of ink drops on an image receiving surface with reference to electronic image data.

In order for the printed images to correspond closely to the image data, both in terms of fidelity to the image objects and the colors represented by the image data, the printheads are registered with reference to the imaging surface and with the other printheads in the printer. Registration of printheads refers to a process in which the printheads are operated to eject ink in a known pattern and then the printed image of the ejected ink is analyzed to determine the relative positions of the printheads with reference to the imaging surface and with reference to the other printheads in the printer. Operating the printheads in a printer to eject ink in correspondence with image data presumes that the printheads are level with one another across a width of the image receiving surface and that all of the inkjets in the printhead are operational. The presumptions regarding the positions of the printheads, however, cannot be assumed, but must be verified. Additionally, if the conditions for proper operation of the printheads cannot be verified, the analysis of the printed image should generate data that can be used either to adjust the printheads so they better conform to the presumed conditions for printing or to compensate for the deviations of the printheads from the presumed conditions.

During operation, one or more inkjets in the printheads may become inoperable. An inoperable inkjet includes any inkjet that fails to eject ink drops on demand, ejects ink drops only intermittently, or ejects ink drops onto an incorrect location on the image receiving surface. Inoperable inkjets in a print zone can produce defects and artifacts in printed images. Some printers detect inoperable inkjets during a print job and compensate for the inoperable inkjets until the printheads containing the inoperable inkjets are cleaned or serviced. Scanned image data from printed patterns that are formed on the image receiving surface are used for both registration of the printheads and for identification of inoperable inkjets.

Analysis of printed images is performed with reference to two directions. "Process direction" refers to the direction in which the image receiving surface is moving as the imaging surface passes the printhead to receive the ejected ink and "cross-process direction" refers to an axis that extends across the width of the image receiving surface, which is perpendicular to the process direction. In order to analyze a printed image, a test pattern needs to be generated in a manner that enables determinations to be made as to whether the inkjets operated to eject ink did, in fact, eject ink and whether the ejected ink landed where the ink would have landed if the printhead was positioned correctly with reference to the image receiving surface and the other printheads in the printer. In some printers, an optical scanner is integrated into the printer and positioned at a location in the printer that enables the scanner to generate image data corresponding to the ink image while the image is on media within the printer or while the ink image is on the rotating image receiving surface in the printer.

These integrated scanners typically include one or more illumination sources and a plurality of optical detectors that receive radiation from the illumination source that has been reflected from the image receiving surface. The radiation from the illumination source is usually visible light, but the radiation can be at or beyond either end of the visible light spectrum. If light is reflected by a white surface, the reflected light has the same spectrum as the illuminating light. In some systems, ink on the imaging surface can absorb a portion of the incident light, which causes the reflected light to have a different spectrum. In addition, some inks may emit radiation in a different wavelength than the illuminating radiation, such as when an ink fluoresces in response to a stimulating radiation. Each optical sensor generates an electrical signal that corresponds to the reflected light received by the detector. The electrical signals from the optical detectors are converted to digital signals by analog to digital converters and provided as digital image data to an image processor.

In many high-volume printers, the image receiving surface moves past the printheads and the optical scanner at high speed in the process direction. For example, some continuous media printers include a media web that moves past the printheads and the optical scanner at a rate of several hundred feet per minute. The optical scanner is only activated for brief periods to capture scanned images of the printed test patterns on the media web while being deactivated when printed images on the media web pass the optical scanner. If the scanned image data include portions of printed images, the registration and inoperable inkjet detection processes may become less effective since the scanned images can be confused with the printed test patterns. Additionally, the printhead registration and inoperable inkjet detection processes are less effective if the optical scanner only captures a portion of the printed test pattern. During operation, small changes in the media web including slip and web shrinkage introduce small errors in synchronization between the locations of the test patterns on the media web and the optical sensor. As the errors accumulate, the optical scanner may capture portions of the media web that include the printed image or may fail to capture the entire printed test pattern. Consequently, improvements to the synchronization of operation for the optical scanner to enable accurate generation of scanned image data for printed test patterns would be beneficial.

SUMMARY

In one embodiment, a method calibrates an optical sensor with reference to image data of scanned marks printed on an image receiving surface in a printer. The method includes operating inkjets in a plurality of printheads to form a plurality of marks on a first region of the image receiving surface as the first region passes the plurality of printheads, the first region having a first length in a process direction, activating an optical sensor to generate first scanned image data corresponding to a second region of the image receiving surface in response to the first region of the image receiving surface moving by a predetermined distance in the process direction, the second region having a second length in the process direction that is longer than the first length of the first region and at least a portion of the first region being contained within the second region, identifying a relative process direction location of the plurality of marks in the first scanned image data with reference to a first end and a second end of the second region in the first scanned image data, identifying an error between the relative process direction location of the plurality of marks in the second region and a predetermined relative process direction location within the second region, adjusting the predetermined distance in the process direction by an amount corresponding to the identified error, and storing a value of the adjusted predetermined distance in a memory to adjust a time of operation for the optical sensor during generation of additional scanned image data of the image receiving surface.

In another embodiment, a different method calibrates an optical sensor with reference to scanned marks printed on an image receiving surface in a printer. The method includes operating inkjets in a reference printhead to form a plurality of marks on a first region of the image receiving surface moving past the inkjets, the first region having a first length in a cross-process axis, activating an optical sensor to generate first scanned image data of a second region of the image receiving surface with a predetermined number of optical detectors that corresponds to the second region of the image receiving surface, the second region of the surface having a second length in the cross-process axis that is longer than the first length and the second region including the first region, the first scanned image data further comprising a plurality of scanlines with each optical detector generating one pixel in each of the plurality of scanlines, identifying a relative cross-process axis location of the plurality of marks in the first scanned image data with reference to a first end and a second end of the second region in the first scanned image data, identifying an error between the relative cross-process axis location of the plurality of marks in the second region and a predetermined relative cross-process axis location within the second region, identifying a predetermined number of pixels in the first scanned image data with a length in the cross-process axis corresponding to the identified error, the predetermined number of pixels extending in the cross-process axis from one of the first end and the second end of the first scanned image data, and storing position data corresponding to the predetermined number of pixels in a memory for use in cropping portions of additional image data generated from the optical sensor corresponding to other regions of the image receiving surface.

In another embodiment, a printer calibrates an optical sensor with reference to scanned marks printed on an image receiving surface in the printer. The printer includes a media transport configured to move a media web in a process direction through a print zone and past an optical sensor, a plurality of printheads in the print zone, each printhead including a plurality of inkjets configured to eject ink drops onto a media web, a sensor operatively connected to a roller in the media transport that engages the media web, the sensor being configured to generate a signal corresponding to a length of movement of the media web in the process direction, and a controller operatively connected to the media transport, the plurality of printheads, the optical sensor, the reflex sensor, and a memory. The controller is configured to operate the media transport to move a first region of the media web through the print zone in the process direction, the first region having a first length in the process direction, operate the inkjets in the plurality of printheads to form a plurality of marks on the first region as the media web moves past the plurality of printheads, activate an optical sensor to generate first scanned image data corresponding to a second region of the media web in response to identification that the media web has moved a predetermined distance in the process direction with reference to signals received from the sensor, the second region having a second length in the process direction that is longer than the first length and at least a portion of the first region being contained within the second region, identify a relative process direction location of the plurality of marks in the first scanned image data with reference to a first end and a second end of the second region in the first scanned image data, identify an error between the relative process direction location of the plurality of marks in the second region and a predetermined relative process direction location within the second region, adjust the predetermined distance of movement for the media web by an amount corresponding to the identified error, and store a value of the adjusted predetermined distance in the memory to adjust a time of operation for the optical sensor during generation of additional scanned image data of the media web.

BRIEF DESCRIPTION OF THE DRAWINGS

The foregoing aspects and other features of a printer that is configured to calibrate the operation of an optical sensor to enable accurate detection of printed test patterns on a moving image receiving surface are described below.

DETAILED DESCRIPTION

Figure 1:
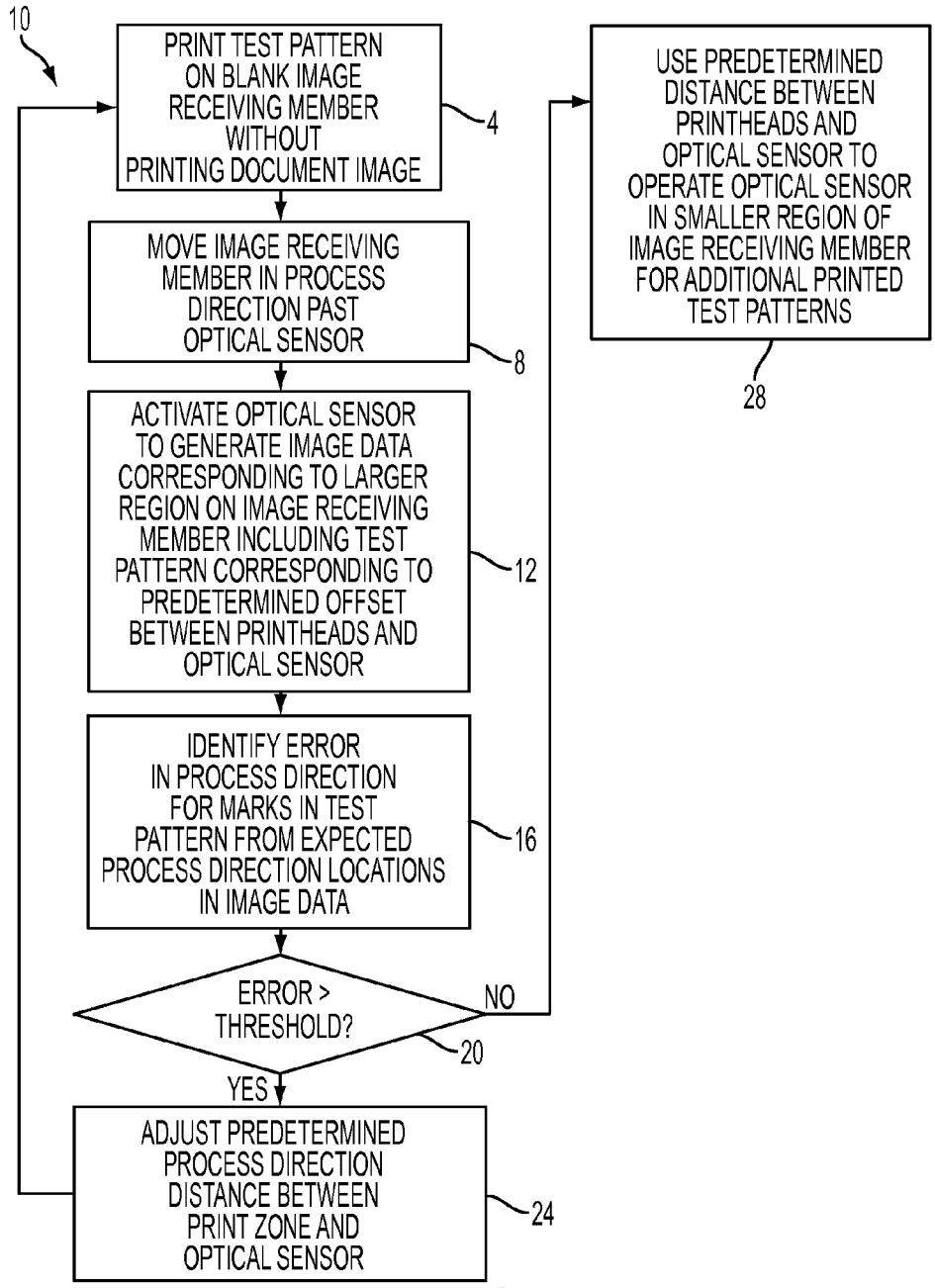
FIG. 1 is a block diagram of a process for adjusting operation of an optical sensor to generate image data including a test pattern formed on an image receiving surface in a process direction of the image data.

For a general understanding of the present embodiments, reference is made to the drawings. In the drawings, like reference numerals have been used throughout to designate like elements. As used herein, the terms "printer" generally refer to an apparatus that applies an ink image to print media and can encompass any apparatus, such as a digital copier, bookmaking machine, facsimile machine, multi-function machine, etc., which performs a print outputting function for any purpose. The printer prints ink images on an image receiving surface, and the term "image receiving surface" as used herein refers to print media or an intermediate member, such as a drum or belt, which carries an ink image and transfers the ink image to a print medium. "Print media" can be a physical sheet of paper, plastic, or other suitable physical substrate suitable for receiving ink images, whether precut or web fed. As used in this document, "ink" refers to a colorant that is liquid when applied to an image receiving surface. For example, ink can be aqueous ink, ink emulsions, melted phase change ink, or gel ink that has been heated to a temperature that enables the ink to be liquid for application or ejection onto an image receiving surface and then return to a gelatinous state. A printer can include a variety of other components, such as finishers, paper feeders, and the like, and can be embodied as a copier, printer, or a multifunction machine. An image generally includes information in electronic form, which is to be rendered on print media by a marking engine and can include text, graphics, pictures, and the like.

As used herein, the term "process direction" refers to a direction of movement of an image receiving surface, such as a print medium or indirect image receiving surface, along a media path through a printer. The image receiving surface moves past one or more printheads in the print zone to receive ink images and passes other printer components, such as heaters, fusers, pressure rollers, and on-sheet imaging sensors, that are arranged along the media path. As used herein, the term "cross-process" direction refers to an axis that is perpendicular to the process direction along the surface of the image receiving surface.

The term "printhead" as used herein refers to a component in the printer that is configured to eject ink drops onto the image receiving surface. A typical printhead includes a plurality of inkjets that are configured to eject ink drops of one or more ink colors onto the image receiving surface. The inkjets are arranged in an array of one or more rows and columns. In some embodiments, the inkjets are arranged in staggered diagonal rows across a face of the printhead. Various printer embodiments include one or more printheads that form ink images on the image receiving surface. Some printer embodiments include a plurality of printheads arranged in a print zone. An image receiving surface, such as a print medium or an intermediate member that holds a latent ink image, moves past the printheads in a process direction through the print zone. The inkjets in the printheads eject ink drops in rows in a cross-process direction, which is perpendicular to the process direction across the image receiving surface.

As used herein, the term "test pattern" refers to a predetermined arrangement of printed marks formed on an image receiving surface by one or more printheads in the printer. In some embodiments, a test pattern includes a predetermined arrangement of a plurality of marks formed by some or all of the inkjets in the printheads arranged in the print zone on a print medium or on an indirect image receiving surface. As used herein, the term "dash" refers to a printed mark formed on an image receiving surface that includes a series of ink drops extending in the process direction formed by a single inkjet in a printhead. A dash can be formed from ink drops located in adjacent pixels in the process direction on the image receiving surface and can include a pattern of on/off adjacent pixels in the process direction. As used herein, the term "pixel" refers to a location on the image receiving surface that receives an individual ink drop from an inkjet. Locations on the image receiving surface can be identified with a grid-like pattern of pixels extending in the process direction and cross-process direction axis on the image receiving surface.

As used herein, the term "reflectance value" refers to a numeric value assigned to an amount of light that is reflected from a pixel on the image receiving surface. In some embodiments, the reflectance value is assigned to an integer value between 0 and 255. A reflectance value of 0 represents a minimum level of reflected light, such as a pixel that is covered in black ink, and a reflectance value of 255 represents a maximum level of reflected light, such as light reflected from white paper or a bare drum surface used as an image receiving surface. In other embodiments the reflectance value can be a non-integer value that covers a different numeric range. Some embodiments measure reflectance values that include multiple numeric values corresponding to different color separations such as red, green, and blue (RGB) values. In a test pattern that includes dashes printed on a highly reflective image receiving surface, the image data corresponding to a dash have lower reflectance values.

As used herein, the term "crop" refers to an image processing operation that processes pixels of image data in a border region in a manner that effectively ignores the data content of the pixels in the border region while processing image pixels in a region adjacent to the border region with reference only to the data content of the image pixels in the border adjacent region. For example, a digital controller or other image processing device can ignore selected pixels from the border of an image while processing the pixels in the uncropped central portion of the image. Crop operations are commonly used in the manipulation of digital photographs to remove regions of image data near the edges of the image data that include unwanted image artifacts, and to change the relative location of features in the uncropped portion of the image compared to the rest of the image. For example, to adjust the relative location of a printed mark in a test pattern to the left in the cross-process direction, the controller crops pixels from the image beginning at the left border of the image to adjust the relative location of the printed image in the remaining uncropped image data. Cropping operations include identifying a plurality of pixels as being an edge that are not the true edge of the image, and overwriting the image pixels in a border region with a predetermined value that enables the pixel values to be processed without affecting the processing of the image pixels in the area of interest. For example, the border region can be overwritten with image data values that correspond to a bare imaging surface so the image values in the border region cannot be mistakenly identified as marks in a test pattern.

Figure 4:
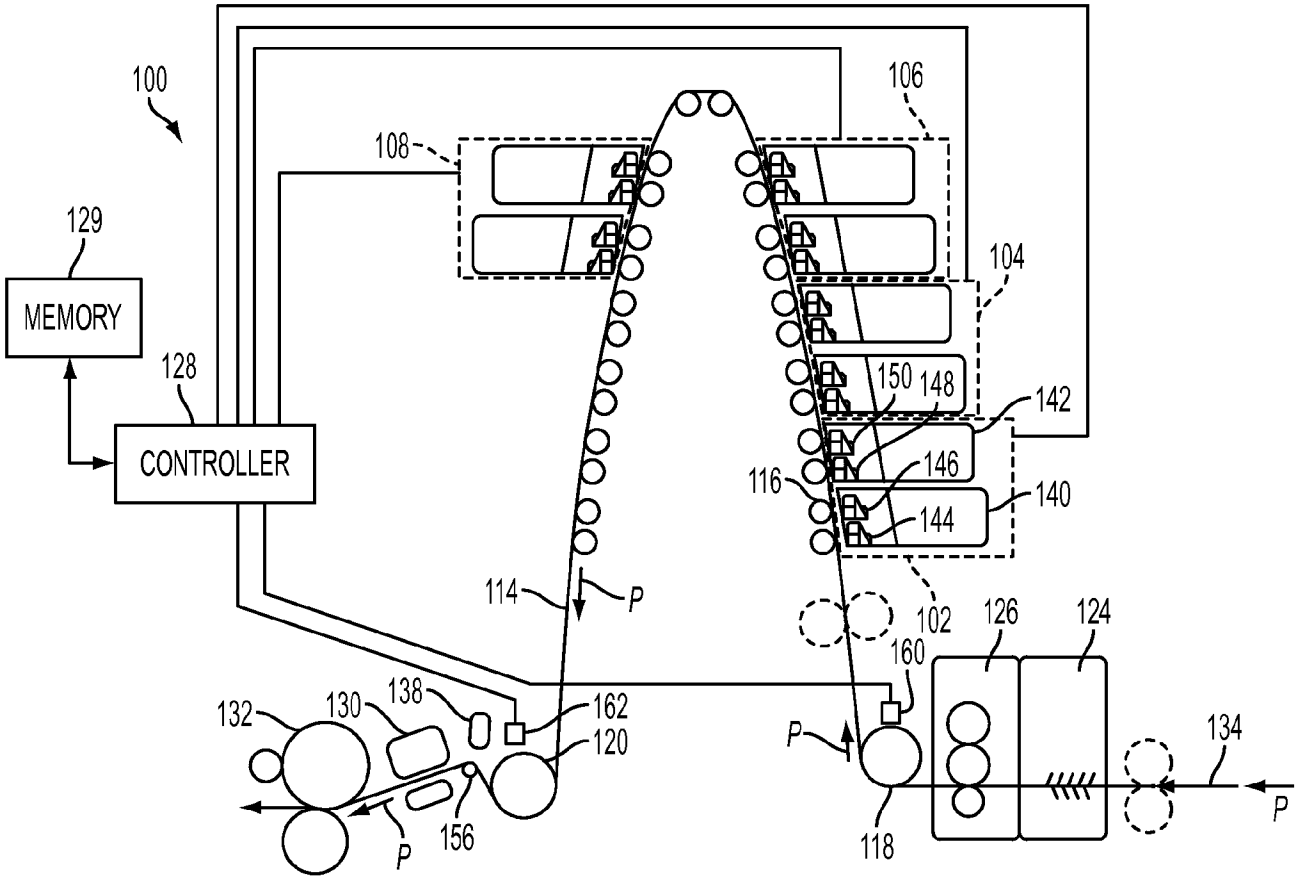
FIG. 4 is a schematic diagram of an inkjet printer that is configured to calibrate the operation of an optical detector to generate image data of printed test patterns that do not include image artifacts from outside the printed test patterns.

FIG. 4 depicts a continuous web printer 100 that includes four print modules 102, 104, 106, and 108; a media path configured to transport a print medium 114 through the printer in a process direction P, a controller 128, a memory 129, optical sensor 138, and encoders 160 and 162. The print modules 102, 104, 106, and 108 are positioned sequentially along the media path and form a print zone for forming images on a print medium 114 as the print medium 114 travels past the print modules. The media web travels through the media path in the process direction P guided by a pre-heater roller 118, backer rollers exemplified by backer roller 116, and a leveler roller 120. A brush cleaner 124 and a contact roller 126 are located at one end of the media path. A heater 130 and a spreader 132 are located at the downstream end of the media path after the media web 114 passes the print modules 102-108 in the print zone. After passing through the media path, a takeup-roller (not shown) winds the media web 114 into a roll for further processing, such as cutting the elongated media web 114 into individual printed sheets. The printer 100 depicts a simplex printer that forms images on a single side of a print medium during a single pass through the media path, but alternative embodiments perform duplex printing on both sides of the media web 114.

In printer 100, each print module 102, 104, 106 and 108 is configured to eject drops of a single color of ink. For example, in a CMYK configuration, the print modules 102, 104, 106, and 108 eject cyan, magenta, yellow, and black (CMYK) inks, respectively. In all other respects, the print modules 102, 104, 106, 108 are substantially identical. Print module 102 includes two print sub modules 140 and 142. Print sub module 140 includes two print units 144 and 146. Print sub module 142 includes two print units 148 and 150. In the print sub module 140, the print units 144 and 146 each include an array of printheads that may be arranged in a staggered configuration across the width of the media in a simplex printer, or both the first section of web media and second section of web media in a duplex printer. In a duplex printing configuration, the first section and the second section of the web media are typically separated by a predetermined distance, and the optical sensor 138 generates image data scanlines that include both the first section and second section of the media web in each scanline. In a typical embodiment, print unit 144 has four printheads and print unit 146 has three printheads. The printheads in print units 144 and 146 are positioned in a staggered arrangement to enable the printheads in both units to emit ink drops in a continuous line across the width of media path at a predetermined resolution. The print sub module 142 includes the same arrangement of printheads in the print units 148 and 150. The two print sub modules 140 and 142 provide a higher print resolution for the print module 102, such as a 600 dots per inch (DPI) resolution for the print module 102 when each of the print sub modules 140 and 142 are configured to print at a 300 DPI resolution.

In the example of FIG. 4, print sub module 140 is configured to emit ink drops in a twenty-inch wide path that includes both the first and optionally second sections of the media web at a resolution of 300 dots per inch. Ink ejectors in each printhead in print units 144 and 146 are configured to eject ink drops onto predetermined locations of both the first and second sections of media web 114. A single backer roller is positioned opposite the printheads in each of the staggered print units 144 and 146, with backer roller 116 being positioned opposite the printheads in print unit 146 by way of example. Print module 102 also includes sub module 142 that has the same configuration as sub module 140, but has a cross-process alignment that differs from sub module 140, so that pixels from sub module 142 are deposited mid-way between pixels from sub module 141. This enables printer 100 to print with twice the resolution as provided by a single print sub module. In the example of FIG. 4, sub modules 140 and 142 enable the printer 100 to emit ink drops with a resolution of 600 dots per inch. As illustrated, a backer roller is positioned opposite each set of printheads in each of the sub modules in the printer 100.

Controller 128 is configured to control various subsystems, components and functions of printer 100. The controller 128 can be implemented with general or specialized programmable processors that execute programmed instructions. Controller 128 is operatively connected to memory 129 to enable the controller 128 to read instructions and read and write data required to perform the programmed functions in memory 129. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

The memory 129 also stores data corresponding to a predetermined distance between the printheads in the print modules 102-108 and the optical sensor 138. In different embodiments, the memory 129 stores distance data as a linear distance (e.g., a unit of microns or millimeters), as a unit of rotational position with reference to the signals received from the sensors 160 and 162 that indicate movement of the media web 114, or as units of time for different linear velocities of the media web 114 during operation of the printer 100. The controller 128 uses the data corresponding to the predetermined distance to adjust a time at which the optical sensor 138 is activated and operated to generate image data, and subsequently, then deactivated. The controller 128 operates the optical sensor 138 to crop image data of the media web 114 to close to the printed test pattern while omitting portions of the media web that are outside of the printed test pattern from the image data. The controller 128 is configured to adjust the predetermined distance data that are stored in the memory 129 to adjust the time of operation for the optical sensor 138 to maintain accurate generation of the image data including the printed test pattern. The memory 129 also stores parameters corresponding to the range of optical detectors in the optical sensor 138 that contain the image data of the test pattern. The controller 128 is configured to crop image data generated by the optical sensor 138 covering a portion of the image receiving surface in the cross-process direction that includes the printed test pattern.

The controller 128 monitors movement of the media web 114 with reference to signals from the encoders 160 and 162, which generate signals in response to rotation of the rollers 118 and 120, respectively. During operation of the printer 100, the media web 114 is propelled in the process direction P, and the media web 114 imparts rotation to the rollers 118 and 120. The rotation of the rollers 118 and 120 produce signals in the sensors 160 and 162, respectively. In one embodiment, the sensors 160 and 162 are Hall effect sensors, and the rollers 118 and 120 each include one or more permanent magnets that are located proximate to the outer circumference of each roller. As the magnets in the rollers 118 and 120 pass the sensors 160 and 162, respectively, the sensors 160 and 162 generate electrical signals that the controller 128 processes to identify the movement of the media web 114 in the process direction P from the sensor signals corresponding to a rotational rate of the rollers 118 and 120. In another embodiment, the sensors 160 and 162 include light detectors and optical encoder discs. The optical encoder disks are affixed to rollers 118 and 120 to rotate in conjunction with the rotation of the rollers 118 and 120. The rotating optical encoder disks trigger the light detectors in the sensors 160 and 162 to generate signals corresponding to the rotation of the rollers 118 and 120, and the controller 128 identifies the correspond movement of the media web 114 in the process direction P. In addition to Hall effect and optical sensors, alternative embodiments of the printer 100 include any sensor that is configured to generate a signal in response to rotation of rollers in the printer, including the rollers 118 and 120, to enable the controller 128 to identify movement of the media web 114.

The rollers 118 and 120 each have a predetermined diameter and circumference. The controller 128 identifies the movement of the media web with reference to the identified rotation of the rollers 118 and 120. For example, in one embodiment the sensor 160 generates a signal in response to completion of a single rotation of the roller 118. The controller 128 identifies a corresponding movement of the media web 114 in the process direction P that corresponds to the predetermined outer circumference of the roller 118. The controller 128 identifies the movement of the media web 114 at the roller 120 with the signals from the sensor 162 in the same manner.

The printer 100 includes two rollers 118 and 120 with corresponding sensors 160 and 162 that enable the controller 128 to monitor the motion of the rollers 118 and 120, and the corresponding motion of the media web 114 in the process direction. The use of two sensors at two locations in the media path is referred to as a "double reflex" printing configuration. Another embodiment includes a single sensor that monitors movement of the media web 114 at a single location along the media path, which is referred to as a "single reflex" printing configuration. As described below, the controller 128 is configured to identify variations in the movement and media path length for the media web 114 to enable the optical sensor 138 to generate image data of printed test patterns using one or more media path movement sensors, including single and double reflex printer configurations.

Controller 128 is operatively connected to the print modules 102-108 and controls the timing of ink drop ejection from the print modules 102-108 onto the media web 114. Controller 128 is also operatively connected to the optical sensor 138 to detect the process and cross-process positions of ink drops on the media web 114 after the ink drops are ejected from the print modules 102-108. Controller 128 is also operatively connected to roller velocity sensors 160 and 162 that enable the controller 128 to identify linear speed of the media web 114 for double reflex printing (DRP). The embodiment of FIG. 4 also shows controller 128 operatively connected to one or more sensors, such as reflex sensor 160 and 162.

The printer 100 includes an optical sensor 138 that is configured to generate image data corresponding to the media web 114 and a backer roller 156. The optical sensor is configured to detect, for example, the presence, reflectance values, and/or location of ink drops jetted onto the receiving surface by the inkjets of the printhead assembly. The optical sensor 138 includes an array of optical detectors mounted to a bar or other longitudinal structure that extends across the width of the media web 114 along the cross-process direction axis. In one embodiment in which the imaging area is approximately twenty inches wide in the cross-process direction and the printheads print at a resolution of 600 dpi in the cross-process direction, over 12,000 optical detectors are arrayed in a single row along the bar to generate a single scanline of image data corresponding to a line across the image receiving surface. The optical detectors are configured in association with one or more light sources that direct light towards the surface of the image receiving surface. The optical detectors receive the light generated by the light sources after the light is reflected from the image receiving surface. The magnitude of the electrical signal generated by an optical detector in response to light being reflected by the bare surface of the media web 114, markings formed on the media web 114, and portions of a backer roller support member 156 that are exposed to the optical sensor 138. The magnitudes of the electrical signals generated by the optical detectors are converted to digital values by an appropriate analog/digital converter.

During operation of the printer 100, the controller 128 activates the printheads in the print modules 102-108 to form printed test patterns on the media web. The controller 128 monitors the motion of the media web 114 and activates the optical sensor 138 to generate images for the region of the media web 114 that includes the printed test patterns. The optical sensor 138 is only activated during a comparatively brief time as the printed test pattern moves past the optical sensor so that the image data generated by the sensor include the printed test pattern, but do not include other printed marks on the media web. The optical sensor 138 is offset from the print modules 102-108 by a predetermined distance in the process direction. Small variations in the size of the media web 114 occur, however, due to media web shrinkage, media web slip and other small variations in the tolerances of the components in the printer 100. The variations in the printer 100 produce positional errors for the location of the printed test pattern in relation to the optical sensor 138 when the optical sensor 138 is activated to generate the image data of the printed test pattern. The positional errors result in the optical sensor 138 generating image data of only a portion of the printed test pattern, or generation of images for portions of the media web 114 that include printed images instead of the printed test pattern.

Figure 3:
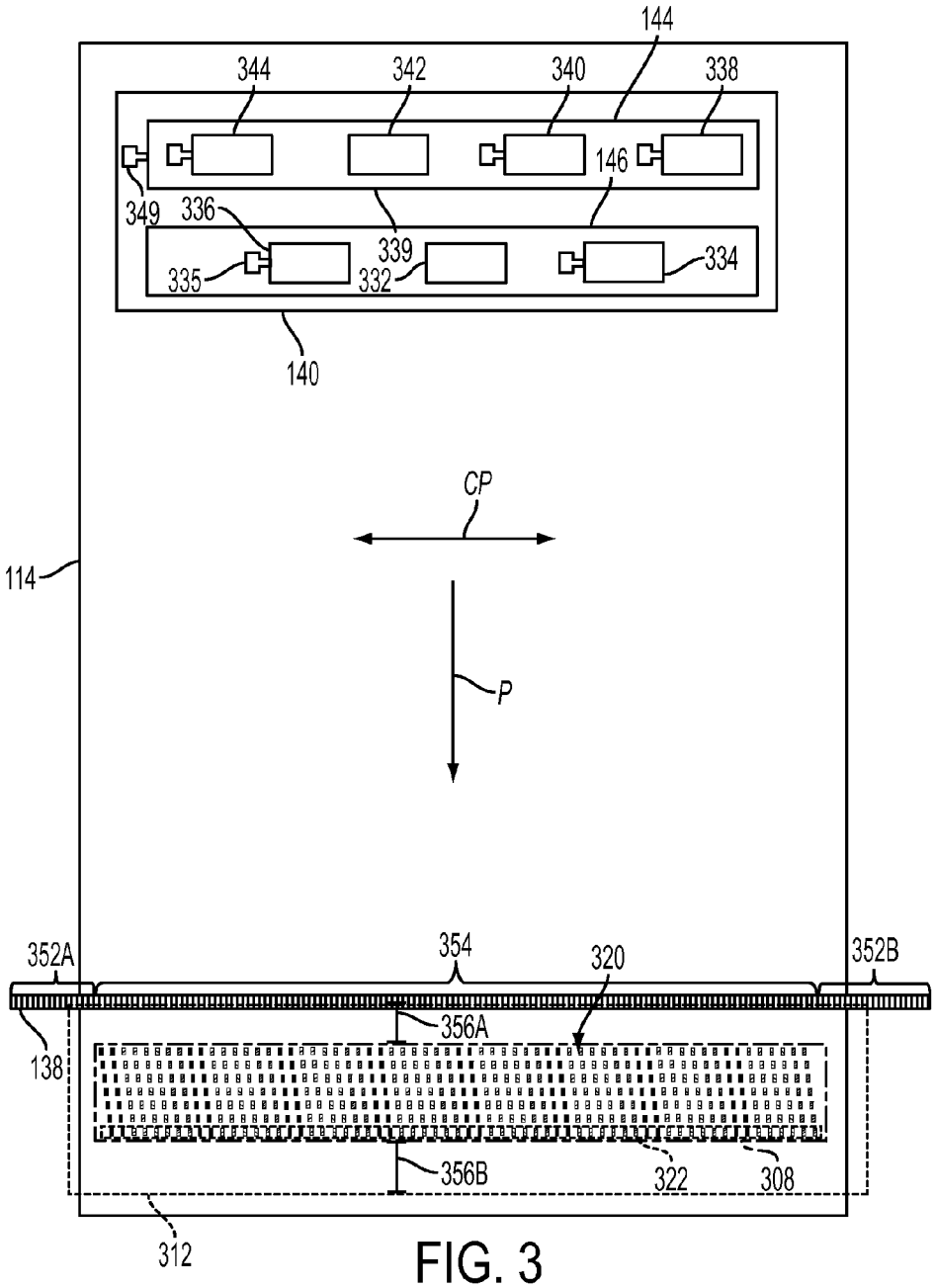
FIG. 3 is a schematic diagram depicting selected components on a print path in a printer including a plurality of printheads that form a portion of a printed test pattern on a print medium, and an optical sensor that generates image data corresponding to the test pattern.

FIG. 3 depicts an illustrative embodiment of a test pattern 320 that is printed on the media web 114. FIG. 3 depicts the print sub module 140, which includes print units 144 and 146, the media web 114, a printed test pattern 320, and the optical sensor 138. The printheads in the print units 144 and 146 form a portion of the printed dashes in the test pattern 320, while the remaining printheads in the sub module 142 and the other print modules 104-108 form the remaining dashes in the test pattern 320. In the print sub module 140, the printhead 332 is referred to as a reference printhead.

During a registration process, the remaining printheads in the sub module 140 and optionally other printheads in the print zone are moved using actuators to align the printheads in the cross-process direction axis CP. The reference printhead 332, however, does not move. Instead, the other printheads in the sub module 140 and other printheads in the print zone move, if needed, to position the printheads in cross-process registration with the reference printhead 332 and with each other. For example, the printheads 334, 336, 338, 340, 342, and 344 are each connected to an electromechanical actuator such as the actuator 335 that is connected to the printhead 336. The actuators adjust the printheads in the cross-process direction to register the inkjets in the printheads so that the inkjets can form a continuous line of ink drops extending across the media web 114 in the cross-process direction CP. The reference printhead 332 does not move in the cross-process direction during registration. In the print unit 144, an actuator 337 moves a support member 349 that supports each of the printheads 338-344 in the cross-process direction CP.

FIG. 1 depicts a process 10 for identification of the distance between the print zone, including the print modules 102-108, and the optical sensor 138 to enable the printer 100 to operate the optical sensor 138 at appropriate times for capture of printed test patterns in image data. In the discussion below, a reference to the process performing a function or action refers to a controller executing programmed instructions stored in a memory to operate one or more components in a printer to perform the function or action. Process 10 is described in conjunction with the printer of FIG. 3 and FIG. 4 for illustrative purposes.

Process 10 begins with printing of a test pattern on the image receiving surface with a large blank region of the image receiving surface surrounding the printed test pattern (block 4). In the printer 100, the controller 128 operates the inkjets in some or all of the print modules 102-108 to form a printed test pattern. In FIG. 3, the printed test pattern 320 is formed from a portion of the inkjets in the print modules 102-108, including some of the inkjets from the printheads 332, 334, 336, 338, 340, 342, and 344 from the print sub module 140. During process 10, the printer 100 forms the test pattern with a large blank region surrounding the test pattern on the media web 114. In FIG. 3, the media web 114 includes a large blank region extending at least a centimeter from the printed test pattern 320. The blank region of the media web 114 enables the optical sensor 138 to generate image data for a large portion of the media web 114 including the test pattern 320, but not including printed images.

Process 10 continues as the image receiving surface moves in the process direction past the optical sensor (block 8) and the optical sensor 138 is activated to generate image data for a region of the image receiving surface with a process direction length that is longer than a length of the printed test pattern (block 12). In the printer 10, the controller 128 operates one or more actuators to move the media web 114 in the process direction P at a predetermined velocity. The controller 128 identifies a time at which the printed test pattern 320 approaches the optical sensor 138 using the predetermined distance data stored in the memory 129 and the signals from the reflex sensors 160 and 162. The controller 128 activates the optical sensor 138 to generate image data of a larger region of the media web 114 that includes both the printed test pattern 320 and blank portions of the media web 114. In FIG. 3, the optical sensor 138 is activated and generates a series of image data scanlines covering the region 312 of the media web 114 that includes both the printed test pattern 320 and blank margins around the printed test pattern 320. In FIG. 3, the blank margins 356A and 356B extend from the region including the printed test pattern 320 in the process direction.

During process 10, the controller 128 identifies the error in the relative process direction location of the printed test pattern in the image data from the optical sensor 138 (block 16). When the optical sensor 138 generates the image data without positional errors, the printed test pattern is centered within the image data in the process direction, with substantially equal margins 356A and 356B extending from the printed test pattern. During process 10, the controller 128 identifies error between the predetermined location of the printed test pattern and the actual location of the printed test pattern in the image data that are received from the optical sensor 138. The controller 128 uses one or more image processing techniques that are known to the art to identify the process direction locations of some or all of the printed marks in the test pattern, including image processing techniques that are used for process direction registration of inkjets and printheads in the printer 10.

In one embodiment, the controller 128 identifies the relative location of one row of dashes in the image data to identify whether a process direction offset of the scanlines that corresponds to the row of dashes corresponds to the expected scanline rows for image data in the printed row of dashes. For example, in FIG. 3 the optical sensor 138 generates the image data for the downstream row of dashes 322 first during the process 10. The controller 128 identifies the relative process direction location of the first row of dashes 322 in the image data for the larger region 312, and identifies error between the expected location of the first row of dashes 322 and the actual process direction location of the first row of dashes. In one embodiment, the controller 128 identifies an average process direction location for the dashes in the first row 322 to reduce the effects of random noise or positional errors in individual inkjets that form the dashes in the first row 322. In another embodiment, the controller 128 identifies the individual process direction location of each dash in the printed test pattern 320, and identifies the process direction location of the printed test pattern 320 as an average of the process direction locations that are identified for each of the dashes. The use of an average location for the dashes in the entire test pattern reduces the likelihood of random noise or individual position errors in dashes from a single row of dashes, while the embodiment that uses a single row of dashes is faster.

During process 10, if the process direction error exceeds a predetermined error threshold (block 20), then the controller 128 adjusts the predetermined process direction distance between the print zone including the print modules 102-108 and the optical sensor 138 (block 24). For example, the controller 128 subtracts the identified error from the predetermined distance data that are stored in the memory 129. The value of the identified error is positive if the actual distance between the print zone and the optical sensor is less than the predetermined distance value stored in the memory 129. The value of the identified error is negative if the actual distance between the print zone and the optical sensor is greater than the predetermined distance value stored in the memory 129.

In the embodiment of the process 10 that is depicted in FIG. 1, the printer 100 performs the processing described with reference to the blocks 4-24 in an iterative manner until the identified error for the location of the printed test patterns is less than the predetermined error threshold. For large process direction position errors, a portion of the dashes in the test pattern may be outside the region 312 for which the optical sensor 138 generates image data during the process 10. A single iteration of the process 10 may correct a portion of the larger error, but when portions of the test pattern are absent from the image data, the process 10 may not fully correct the identified process direction error. Additionally, the correction applied in any single iteration may be limited in order to prevent a single erroneous reading of the test pattern location from moving the image too far in the process direction. Consequently, the printer 100 optionally performs process 10 in an iterative manner until the identified error is below the predetermined threshold to correct larger process direction errors. In another embodiment, the printer 100 adjusts the predetermined distance value to correct the identified process direction location error once before proceeding to the processing that is described with reference to block 28.

If the controller 128 identifies that the location of the printed test pattern 320 is within the predetermined error threshold (block 20), then the printer 100 operates the optical sensor 138 with reference to the predetermined distance to generate image data corresponding to a smaller region of the image receiving surface that includes subsequent printed test patterns (block 28). For example, in FIG. 3 the smaller region 308 includes the test pattern 320 with minimal margins formed around the test pattern 320. During a print job, the printer 100 forms test patterns that are similar to the test pattern 320 on the media web 114 in regions that are between the printed pages of the print job. The controller 128 prints the test patterns and activates the sensor 138 in response to identifying that the media web 114 has moved the predetermined distance from the print zone in the process direction with reference to the signals from the reflex sensors 160 and 162. The controller 128 activates the optical sensor 138 to generate image data of the printed test pattern that includes each of the marks formed in the test pattern, while also excluding portions of the printed images and other marks that are formed on the media web 114. The controller 128 uses the image data of the printed test patterns for registration of printheads and identification of inoperable inkjets in the print modules 102-108 to enable high-quality image production during a print job that includes multiple printed pages.

Figure 2:
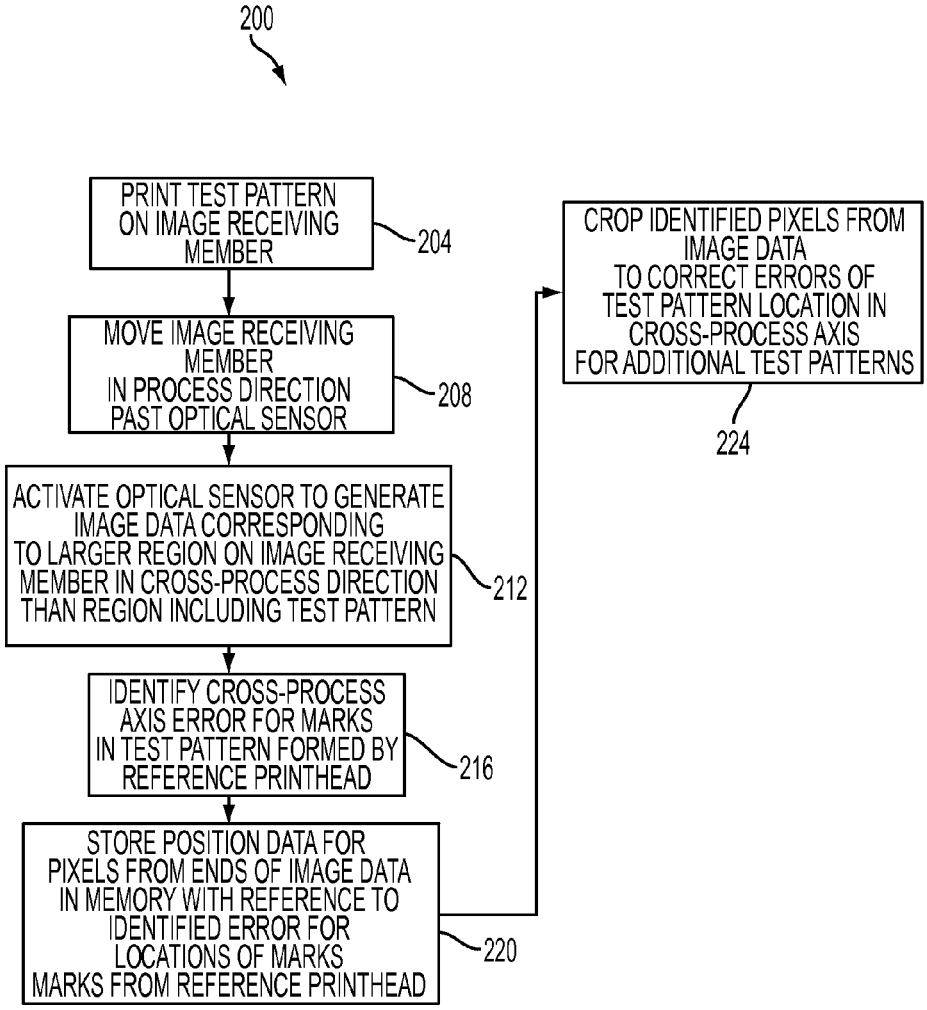
FIG. 2 is a block diagram of a process for adjusting a number of optical detectors in an optical sensor that are activated to generate image data of a printed test pattern in a cross-process direction on the image receiving surface.

FIG. 2 depicts a process 200 for identification of the individual optical detectors in the optical sensor that should be cropped from the image data in the cross-process direction of the image receiving surface that includes printed test patterns. In the discussion below, a reference to the process performing a function or action refers to a controller executing programmed instructions stored in a memory to operate one or more components in a printer to perform the function or action. Process 200 is described in conjunction with the printer of FIG. 3 and FIG. 4 for illustrative purposes.

Process 200 begins as the printer forms a printed test pattern on the image receiving surface (block 204), and moves the image receiving surface in the process direction past the optical sensor (block 208). In the printer 10, the controller 128 operates the print modules 102-108 to form a printed test pattern on the media web 114 as the media web 114 moves through the print zone and past the optical sensor 138 in the process direction P. The processing described with reference to the blocks 204 and 208 in FIG. 2 is substantially the same as the processing described above with reference to the blocks 4 and 8, respectively, in FIG. 1. The process 10 and process 200 optionally use a single test pattern that is printed once for use in both calibration of the process direction and cross-process direction operation of the optical sensor 138.

During process 200, the optical sensor generates image data of the test pattern using a first set of optical detectors that generate image data for a larger region of the image receiving surface than the portion of the image receiving surface that includes the printed test pattern (block 212). For example, in FIG. 3, the controller 128 activates the optical detectors 352A, 354, and 352B in the optical sensor 138 to generate image data across a full-width of the media web 114 and beyond the edges of the media web 114 in the cross-process direction CP. The optical sensor 138 generates a series of image data scanlines where each scanline includes a pixel generated by one of the activated optical detectors to generate image data in the region 312. In another configuration, the controller 128 activates a range of optical detectors in the optical sensor that detect light reflected from the image receiving surface, but does not activate optical detectors that are past the cross-process direction edges of the image receiving surface. In still another configuration, the controller 128 activates all of the optical detectors in the optical sensor 138. In one embodiment, only the activated optical detectors in the optical sensor 138 generate pixels in the scanlines that form the image data including the printed test pattern and regions outside of the printed test pattern. In another embodiment, all of the optical detectors in the optical sensor 138 generate the image data, but the controller 128 selectively ignores or "crops" the image data from the selected optical detectors.

Process 200 continues as the controller 128 identifies errors between the locations of printed marks from the reference printhead in the image data corresponding to the test pattern and the expected locations of the marks in the test pattern (block 216). As depicted in FIG. 3, a reference printhead 332 forms a portion of the printed dashes in the test pattern 320. The reference printhead 332 occupies a predetermined fixed location on the cross-process axis CP. The optical detectors in the optical sensor 138 generate image data pixels corresponding to the printed dashes from the reference printhead 332, and the controller 128 identifies a cross-process direction error between the relative locations of optical detectors that generate the image data corresponding to the marks from the reference printhead and the bounds of the image data in the cross-process direction.

Process 200 continues as the controller 128 identifies pixels in the image data that correspond to the identified cross-process axis error and stores position data of the identified pixels in the memory 129 (block 220). For example, in the optical sensor 138, each one of the optical detectors generates a single pixel in each scanline of image data. Each image data pixel covers a predetermined length of the generated image data extending in the cross-process axis CP. The controller 128 identifies a predetermined number of pixels that correspond to the length of the identified error in the cross-process axis CP and identifies a position of pixels extending from either end of the image data on the cross-process axis CP to correct the error. For example, the controller 128 identifies a portion of the pixels 352A that correspond to the length of the error in the cross-process axis CP when the error for the apparent location of the printed marks of the reference printhead 332 is offset left in FIG. 3. Similarly, the controller 128 identifies a portion of the pixels 352B that correspond to the length of the error in the cross-process axis CP when the error for the apparent location of the printed marks of the reference printhead 332 is offset right in FIG. 3. The controller 128 stores position information corresponding to the identified pixels in the image data, such as pixel column numbers or pixel range data, in the memory 129. Thus, the optical sensor 138 generates image data using all of the optical detectors in the optical sensor 138, and the controller 128 identifies a region of pixels to crop from the image data to shift the relative locations of the printed marks in the test pattern along the cross-process direction axis to the expected relative location within the cropped image data.

Process 200 continues as the controller 128 crops the pixels in the positions stored in the memory 129 to correct the cross-process axis locations of image data including additional test patterns that are printed on other regions of the image receiving surface during a print job (block 224). As depicted in FIG. 3, the controller 128 operates the print modules 102-108 during a print job to generate additional test patterns to maintain printhead registration and identify inoperable inkjets in the print zone. The optical sensor 138 generates the image data including the printed test patterns. The controller 128 crops pixels in the scanned image data to correct the cross-process direction error that is identified above. In addition to cropping the identified pixels to correct the relative cross-process location of the printed marks in the test pattern, the controller 128 optionally crops additional pixels from either end of the scanned image data in the cross-process axis to remove image features that are outside of the region of the image including the printed test pattern. For example, the controller 128 crops image data from the optical sensors that extend past the edges of the media web 114 on the cross-process direction axis. The edges of the media web and regions outside of the media web often include noise that increase the difficulty in reliably analyzing the image data from the printed test patterns. Thus, the process 200 enables the printer 100 to generate image data that includes the printed test pattern and excludes image artifacts from other regions on and outside the media web 114.

As described above, the process 10 calibrates the operation of an optical sensor to generate image data of the process direction region of the image receiving surface that includes a printed test pattern, and the process 200 calibrates the operation of the optical sensor to generate image data of the cross-process direction region of the image receiving surface that includes the printed test image. The processes 10 and 200 can be performed in any order or concurrently to adjust the operation of the optical sensor for detection of the printed test patterns.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for calibration of an optical sensor to scan printed marks on an image receiving surface in a printer comprising:

operating inkjets in a plurality of printheads to form a plurality of marks on a first region of the image receiving surface as the first region passes the plurality of printheads, the first region having a first length in a process direction;

activating an optical sensor to generate first scanned image data corresponding to a second region of the image receiving surface in response to the first region of the image receiving surface moving by a predetermined distance in the process direction, the second region having a second length in the process direction that is longer than the first length of the first region and at least a portion of the first region being contained within the second region;

identifying a relative process direction location of the plurality of marks in the first scanned image data with reference to a first end and a second end of the second region in the first scanned image data;

identifying an error between the relative process direction location of the plurality of marks in the second region and a predetermined relative process direction location within the second region;

adjusting the predetermined distance in the process direction by an amount corresponding to the identified error; and storing a value of the adjusted predetermined distance in a memory to adjust a time of operation for the optical sensor during generation of additional scanned image data of the image receiving surface.

2. The method of claim 1, the generation of additional scanned image data further comprising:

operating the inkjets in the plurality of printheads to form another plurality of marks on a third region of the image receiving surface moving past the plurality of printheads, the third region having the first length in the process direction; and activating the optical sensor to generate second scanned image data corresponding to a fourth region of the image receiving surface in response to movement of the third region of the image receiving surface by the adjusted predetermined distance value stored in the memory, the fourth region having a third length in the process direction that is longer than the first length and shorter than the second length.

3. The method of claim 2 further comprising:

identifying a registration offset between a first printhead and a second printhead in the plurality of printheads that form the printed marks with reference to the second scanned image data.

4. The method of claim 2 further comprising:

identifying an inoperable inkjet in the plurality of printheads with reference to the second scanned image data.

5. The method of claim 1, the forming of the plurality of marks in the first region further comprising:

operating a plurality of inkjets in at least one printhead to form a plurality of rows of marks that extend in a cross-process direction across the first region of the image receiving surface.

6. The method of claim 5, the identification of the error further comprising:

identifying a relative location of a first row in the plurality of rows of printed marks in the second region in the process direction; and identifying the error with reference to a process direction distance between the identified relative location of the first row of printed marks in the second region and the predetermined relative location within the second region.

7. The method of claim 5 further comprising:

identifying a relative average location of the plurality of rows of printed marks in the second region in the process direction; and identifying the error with reference to a process direction distance between the identified relative average location of the plurality of rows in the second region and the predetermined relative location within the second region.

8. A method for calibration of an optical sensor to scan printed marks on an image receiving surface in a printer comprising:

operating inkjets in a reference printhead to form a plurality of marks on a first region of the image receiving surface moving past the inkjets, the first region having a first length in a cross-process axis;

activating an optical sensor to generate first scanned image data of a second region of the image receiving surface with a predetermined number of optical detectors that corresponds to the second region of the image receiving surface, the second region of the surface having a second length in the cross-process axis that is longer than the first length and the second region including the first region, the first scanned image data further comprising a plurality of scanlines with each optical detector generating one pixel in each of the plurality of scanlines;

identifying a relative cross-process axis location of the plurality of marks in the first scanned image data with reference to a first end and a second end of the second region in the first scanned image data;

identifying an error between the relative cross-process axis location of the plurality of marks in the second region and a predetermined relative cross-process axis location within the second region;

identifying a predetermined number of pixels in the first scanned image data with a length in the cross-process axis corresponding to the identified error, the predetermined number of pixels extending in the cross-process axis from one of the first end and the second end of the first scanned image data; and storing position data corresponding to the predetermined number of pixels in a memory for use in cropping portions of additional image data generated from the optical sensor corresponding to other regions of the image receiving surface.

9. The method of claim 8 further comprising:

operating the inkjets in the reference printhead to form another plurality of marks on a third region of the image receiving surface moving past the inkjets, the third region having the first length in the cross-process axis;

activating the optical sensor to generate second scanned image data of a fourth region of the image receiving surface, the fourth region of the image receiving surface including the third region with the other plurality of printed marks; and cropping the second scanned image data with reference to the position data stored in the memory to remove pixels extending in the cross-process axis from one of a first or second end of the second image data to adjust a relative location of the other plurality of marks in cross-process axis in the second image data.

10. The method of claim 9 further comprising:

identifying a registration offset between a first printhead and a second printhead in the plurality of printheads that form the printed marks with reference to the second scanned image data.

11. The method of claim 9 further comprising:

identifying an inoperable inkjet in the plurality of printheads with reference to the second scanned image data.

12. The method of claim 8, wherein the predetermined relative location in the cross-process axis within the second region is a center of the second region in the cross-process axis corresponding to a location of the reference printhead in the cross-process axis.

13. A printer comprising:

a media transport configured to move a media web in a process direction through a print zone and past an optical sensor;

a plurality of printheads in the print zone, each printhead including a plurality of inkjets configured to eject ink drops onto a media web;

a sensor operatively connected to a roller in the media transport that engages the media web, the sensor being configured to generate a signal corresponding to a length of movement of the media web in the process direction; and a controller operatively connected to the media transport, the plurality of printheads, the optical sensor, the reflex sensor, and a memory, the controller being configured to:

operate the media transport to move a first region of the media web through the print zone in the process direction, the first region having a first length in the process direction;

operate the inkjets in the plurality of printheads to form a plurality of marks on the first region as the media web moves past the plurality of printheads;

activate an optical sensor to generate first scanned image data corresponding to a second region of the media web in response to identification that the media web has moved a predetermined distance in the process direction with reference to signals received from the sensor, the second region having a second length in the process direction that is longer than the first length and at least a portion of the first region being contained within the second region;

identify a relative process direction location of the plurality of marks in the first scanned image data with reference to a first end and a second end of the second region in the first scanned image data;

identify an error between the relative process direction location of the plurality of marks in the second region and a predetermined relative process direction location within the second region;

adjust the predetermined distance of movement for the media web by an amount corresponding to the identified error; and store a value of the adjusted predetermined distance in the memory to adjust a time of operation for the optical sensor during generation of additional scanned image data of the media web.

14. The printer of claim 13, the controller being further configured to:

continue to operate the media transport to move a third region of the media web through the print zone in the process direction, the third region of the media web having the first length in the process direction;

operate the inkjets in the plurality of printheads to form another plurality of marks on the third region of the media web as the media web moves past the plurality of printheads; and activate the optical sensor to generate second scanned image data corresponding to a fourth region of the media web in response to identification that the media web has moved by the adjusted predetermined distance in the process direction with reference to the signals received from the sensor, the fourth region having a third length in the process direction that is longer than the first length and shorter than the second length.

15. The printer of claim 13, the optical sensor further comprising:

a plurality of optical detectors arranged in a cross-process axis across a surface of the media web, the optical sensor being configured to generate scanned image data including a plurality of scanlines with each optical detector generating one pixel in each of the plurality of scanlines; and the controller being further configured to:

identify a relative cross-process axis location in the first scanned image data of a portion of the plurality of marks that are formed by a reference printhead in the plurality of printheads with reference to a third end and a fourth end of the second region in the cross-process axis in the first scanned image data;

identify another error between the relative cross-process axis location of the portion of the plurality of marks in the second region and a predetermined relative cross-process axis location within the second region;

identify a predetermined number of the pixels in the first scanned image data with a length in the cross-process axis corresponding to the other identified error, the predetermined number of pixels extending in the cross-process axis from one of the third end and the fourth end of the first scanned image data; and store position data corresponding to the predetermined number of pixels in the memory for use in cropping portions of additional image data generated from the optical sensor corresponding to other regions of the media web.

16. The printer of claim 15, the controller being further configured to:

operate the plurality of inkjets in the plurality of printheads to form another plurality of marks on a third region of the media web, the third region having the first length in the cross-process axis;

activating the optical sensor to generate second scanned image data of a fourth region of the media web, the fourth region of the media web including the third region with the other plurality of printed marks; and crop the second scanned image data with reference to the position data stored in the memory to remove pixels extending in the cross-process axis from one of a first end and a second end of the second image data to adjust a relative location of the other plurality of marks in cross-process axis in the second image data.

17. The printer of claim 13, the controller being further configured to:

operate the plurality of inkjets to form a plurality of rows of printed marks that extend in a cross-process axis across the first region of the media web.

18. The printer of claim 17, the controller being further configured to:

identify a relative location of a first row in the plurality of rows of printed marks in the second region in the process direction; and identify the error with reference to a process direction distance between the identified relative location of the first row of printed marks in the second region and the predetermined relative location within the second region.

19. The printer of claim 17, the controller being further configured to:

identify a relative average location of the plurality of rows of printed marks in the second region in the process direction; and identify the error with reference to a process direction distance between the identified relative average location of the plurality of rows in the second region and the predetermined relative location within the second region.

* * * * *